US008368600B2

(12) United States Patent
Wang et al.

(10) Patent No.: US 8,368,600 B2
(45) Date of Patent: Feb. 5, 2013

(54) DUAL-BAND ANTENNA AND WIRELESS NETWORK DEVICE HAVING THE SAME

(75) Inventors: Yu-Jen Wang, Taipei (TW); Wei-Bin Lee, Taipei (TW)

(73) Assignee: Cameo Communications Inc (TW)

( * ) Notice: Subject to any disclaimer, the term of this patent is extended or adjusted under 35 U.S.C. 154(b) by 346 days.

(21) Appl. No.: 12/807,601

(22) Filed: Sep. 8, 2010

(65) Prior Publication Data

US 2011/0001669 A1 Jan. 6, 2011

(30) Foreign Application Priority Data

Jun. 9, 2010 (TW) ..... 99210940 U

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702
See application file for complete search history.

(56) References Cited

U.S. PATENT DOCUMENTS 6,639,558 B2 * 10/2003 Kellerman et al. .... 343/700 MS
6,982,672 B2 * 1/2006 Lin et al. ..... 343/700 MS

* cited by examiner

*Primary Examiner* — Hoang V Nguyen

(57) ABSTRACT

A dual-band antenna for use in a wireless network device comprises first, second, and third radiators. The first and second radiators are connected by a stand portion. The second radiator is a generally C-shaped plate having a connecting section and a free-end portion. A ground end and an input end are provided at predetermined positions of the connecting section and are respectively and electrically connected to a grounding portion and a control circuit of a substrate. The free-end portion overlaps with the orthogonal projection of the first radiator and is parallel to the first radiator. The third radiator is electrically connected to the second radiator via a conductive post and is parallel to the second radiator. The second and third radiators are provided on the substrate while the first radiator is provided outside the substrate. The first, second, and third radiators are parallel to and spaced apart from one another.

10 Claims, 12 Drawing Sheets

DUAL-BAND ANTENNA AND WIRELESS NETWORK DEVICE HAVING THE SAME

BACKGROUND OF INVENTION

1. Field of the Invention

The present invention relates to a dual-band antenna and, more particularly, to a bilaterally symmetric dual-band antenna for use in a wireless network device, and a wireless network device having such an antenna.

2. Description of the Prior Art

Please refer to FIG. 1 for a perspective view of a conventional wireless network device 10 in the form of a wireless network card. The wireless network device 10 typically includes: a main body 11, an internal circuit device 12 provided in the main body 11, a connector portion 13 located at one end of the main body 11 and configured for connecting with an external host (not shown), and an antenna signal transceiver portion 14 disposed at the end of the main body 11 that is opposite the connector portion 13. Generally, the antenna signal transceiver portion 14 has a non-metal housing and, when the wireless network device 10 is connected, to an external host, must be exposed outside the external host in order to transmit and receive wireless signals effectively.

FIG. 2 shows a conventional internal circuit device 20 for use in a wireless network device. The internal circuit device 20 includes: a substrate 21, a control circuit 22 provided on the substrate 21, a grounding element 23 covering a predetermined region of the substrate 21, and an antenna unit 24 electrically connected to the control circuit 22. The conventional antenna unit 24 shown in FIG. 2 includes a first antenna 241 and a second antenna 242 which are provided on two lateral sides of the substrate 21, respectively. Moreover, the antennas 241, 242 of the conventional internal circuit device 20 are both designed as printed monopole antennas on the substrate 21. However, due to their limited difference in height in the vertical direction, such printed antennas can only achieve the desired radiation patterns and high gain in the X-Y plane (i.e., along the horizontal directions) by varying the shapes of the first and second antennas 241, 242 but can hardly be improved in terms of gain in the Z direction. With the "vertical stand" design being the design trend of today's wireless network devices in order to save space and lend a sense of modernity and technology to the devices, the low gain of the conventional printed antennas particularly in the Z direction simply cannot satisfy the requirements of wireless network devices having a vertical stand configuration.

For instance, FIG. 3 shows X-Y plane radiation patterns plotted from test results of the first antenna 241 of the conventional printed antenna unit 24 illustrated in FIG. 2. As can be seen in the radiation patterns of FIG. 3, the maximum gain of the first antenna 241 in the vertical direction is merely −15.89 dBi, which is obviously lower than consumers' acceptable lower gain limit (typically −10 dBi) and therefore does not meet the design requirements of high-performance antennas on the market.

SUMMARY OF INVENTION

The primary object of the present invention is to provide a dual-band antenna wherein two symmetric and externally independent radiators and a plurality of parallel radiators provided in a multilayer substrate are vertically connected to effect mutual oscillation and thereby produce a high frequency and a low frequency. Thus, the dual-band antenna features not only high vertical gain but also few dead zones.

In order to achieve the aforementioned objective, the present invention discloses a dual-band antenna. The dual-band antenna is provided on a substrate and comprising:

a first radiator;

a second radiator which is generally C-shaped and has a connecting section and a free-end portion, wherein a ground end and an input end are provided at predetermined positions of the connecting section and are respectively and electrically connected to a grounding portion and a control circuit of the substrate, and wherein the free-end portion overlaps with an orthogonal projection of the first radiator and is parallel to the first radiator;

a third radiator electrically connected to the second radiator via a conductive post and being parallel to the second radiator; and a stand portion connected to the first radiator and the second radiator;

wherein the substrate is a multilayer printed circuit board, the second and third radiators being provided on different layers of the substrate, the first radiator being independently provided outside the substrate, and the first, second, and third radiators being parallel to and spaced apart from one another by a predetermined distance.

In a preferred embodiment, the second radiator is configured for signal oscillation and thereby producing a first frequency, and the first radiator is configured for signal oscillation and thereby producing a second frequency, the dual-band antenna thus having a dual-band function.

In a preferred embodiment, the first frequency ranges from 2.4 GHz to 2.5 GHz, and the second frequency ranges from 4.9 GHz to 5.85 GHz.

In a preferred embodiment, the first radiator and the stand portion are integrally formed as a single piece by stamping a thin conductive metal plate and are perpendicular to each other.

In a preferred embodiment, the dual-band antenna comprises two corresponding antennas respectively and symmetrically provided on two lateral sides of the substrate, wherein the two antennas substantially correspond in shape to each other.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF PREFERRED EMBODIMENTS

Figure 6A:
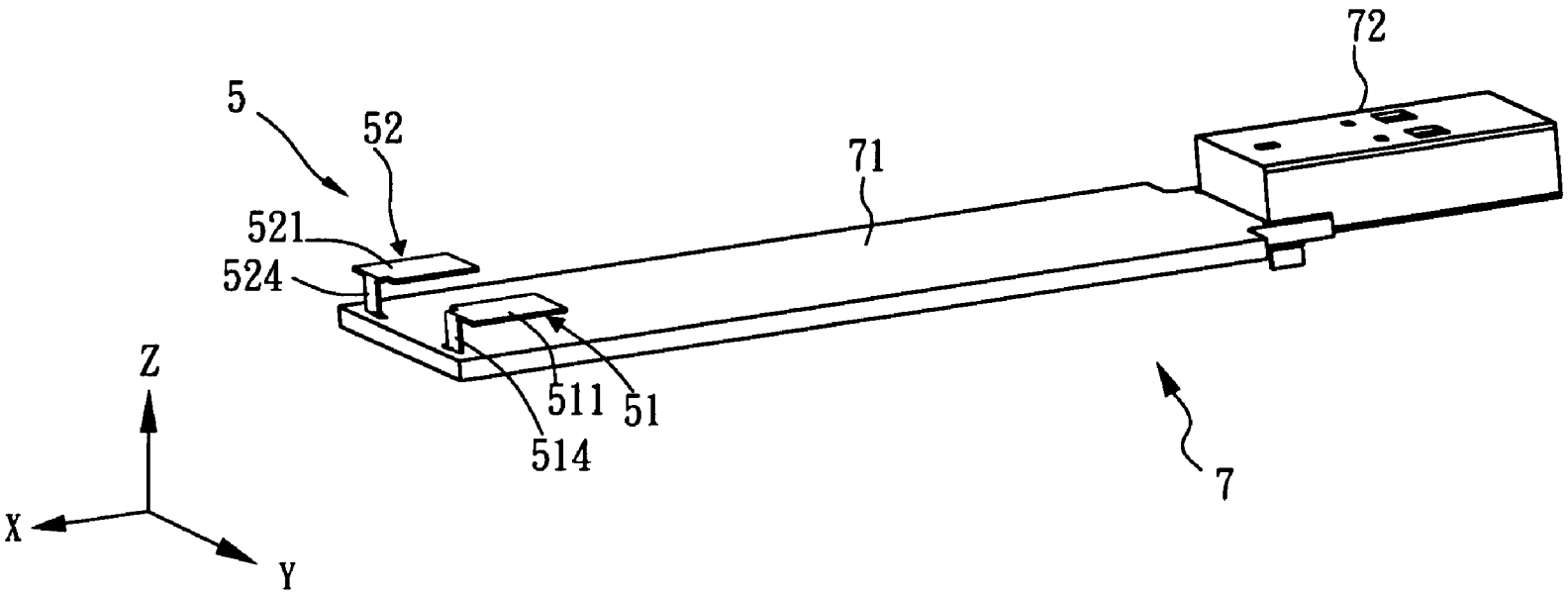
FIG. 6A is a perspective view of a wireless network device having the dual-band antenna of the present invention.
Figure 6B:
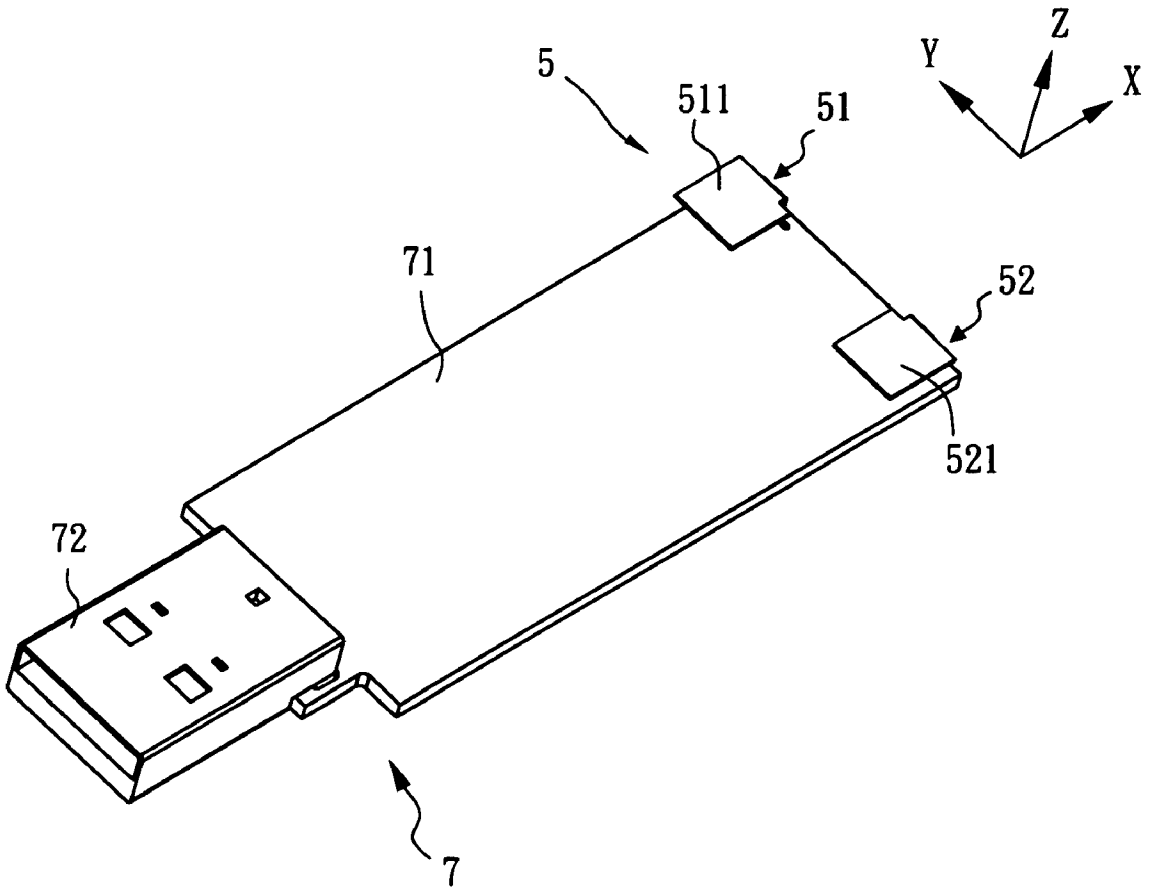
FIG. 6B is another perspective view of the wireless network device shown in FIG. 6A, when viewed from a different angle.

In the present invention, a dual-band antenna and a wireless network device having the same are designed on the principle that two (left and right) exposed and independent radiators, each integrally formed by stamping, are symmetrically and electrically connected to at least two other radiators in a substrate (e.g., a multilayer printed circuit board) to form two corresponding antenna portions, and that the substrate has a universal serial bus (USB) connector end in addition to the two antenna portions and thus forms a dual-band wireless network device which operates in both a high-frequency band and a low-frequency band, has high vertical gain, and can be conveniently made and assembled at low costs. FIGS. 6A and 6B show two perspective views of a wireless network device 7 having a dual-band antenna 5 of the present invention, wherein the wireless network device 7 includes a substrate 71 and a USB connector end 72.

Figure 5:
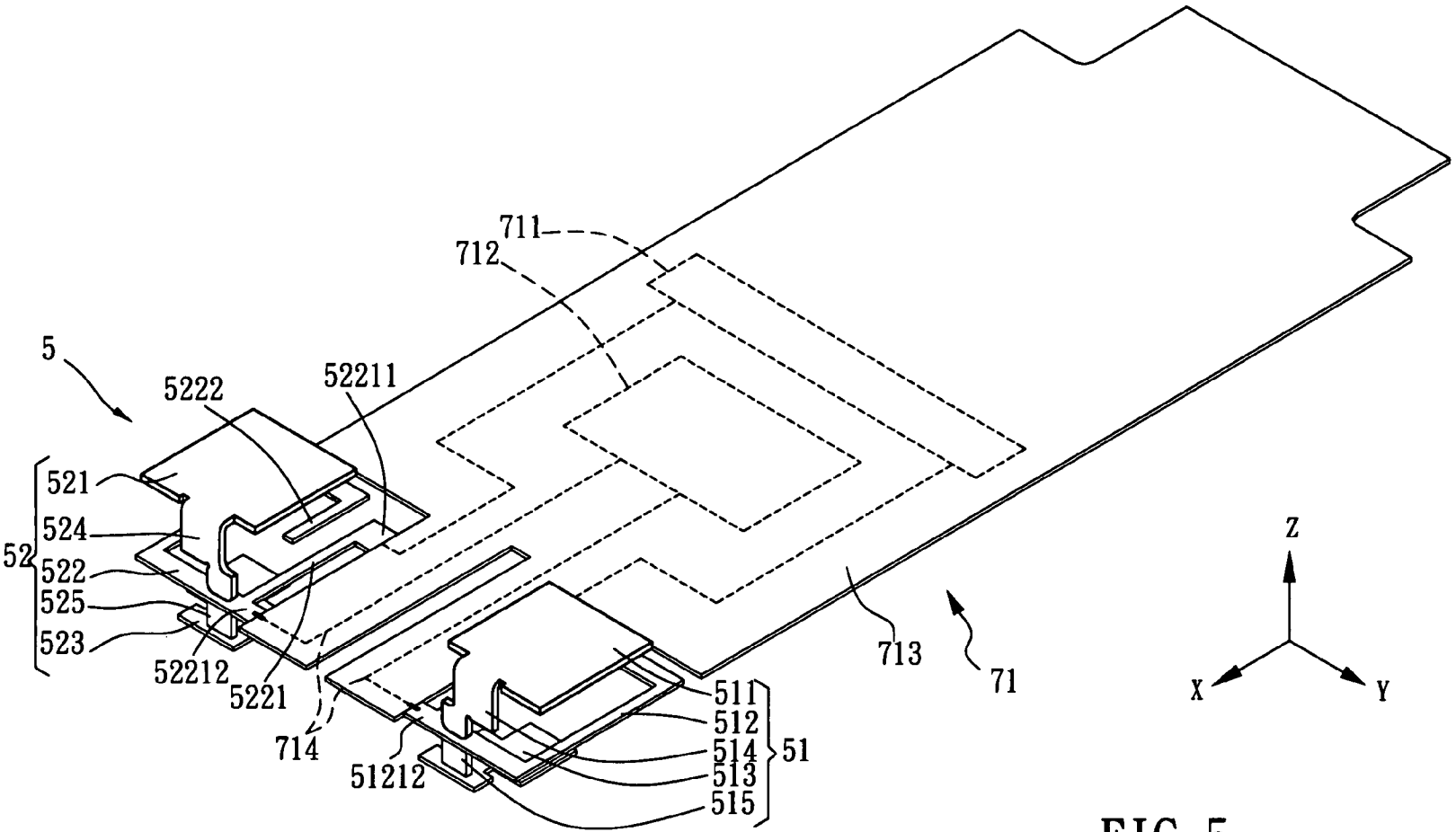
FIG. 5 is a perspective view showing connection between a substrate and the dual-band antenna of the present invention.

The substrate 71 is a multilayer printed circuit board made of a dielectric material and having a flat rectangular structure. As shown in FIG. 5, the substrate 71 includes a grounding (GND) portion 711, a control circuit 712, and a plurality of circuit layers 713. The grounding portion 711 is configured for electrical grounding and at least partially covers one of the circuit layers 713. The control circuit 712, which includes a circuit layout, several integrated circuit (IC) elements, and several electronic elements, is provided on one of the circuit layers 713 in the substrate 71 and configured for providing wireless network transmission. As the control circuit 712 is well known in the art and not a major technical feature of the present invention, a detailed description of the control circuit 712 is omitted herein.

Figure 4A:
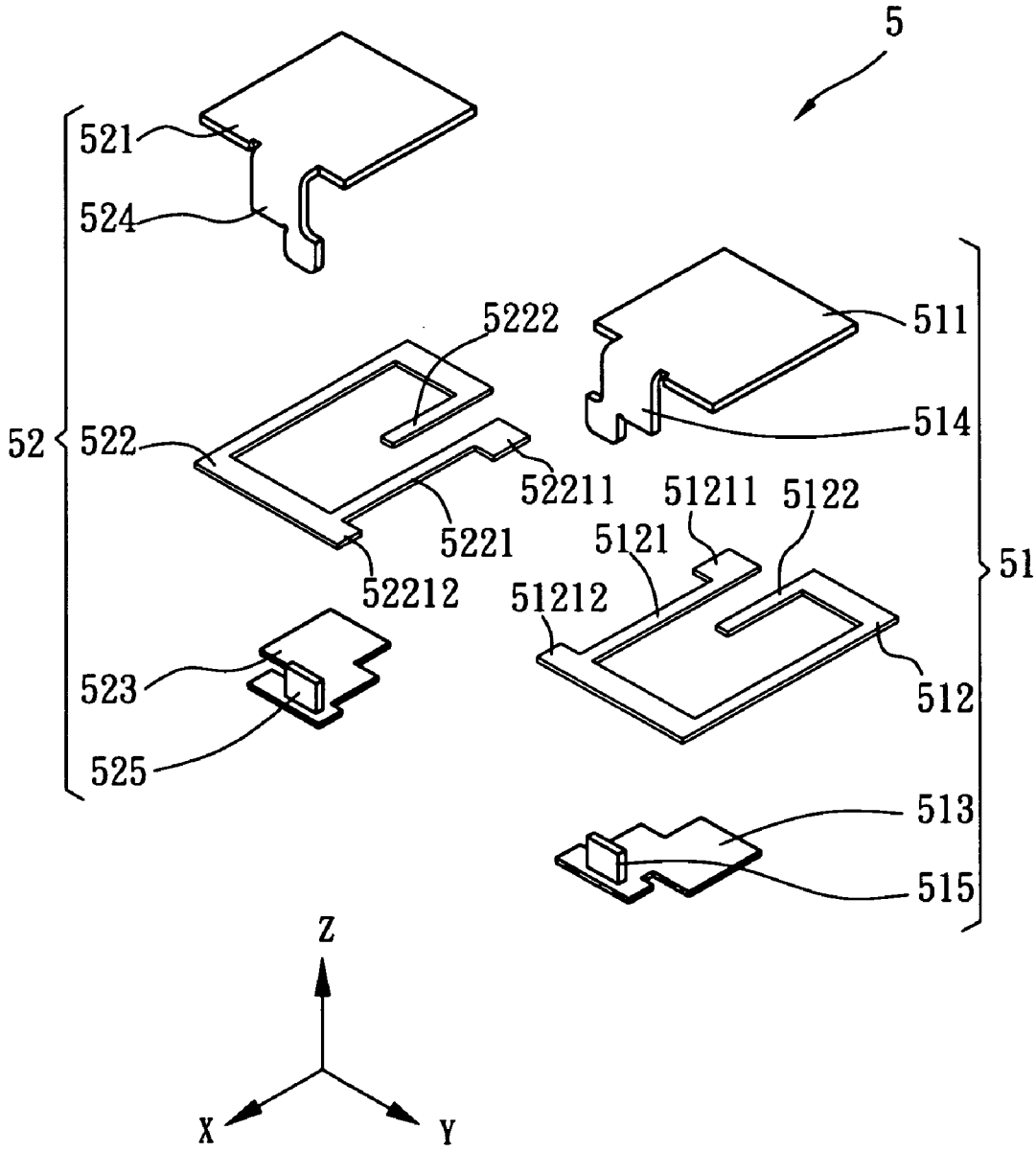
FIG. 4A is an exploded perspective view of a dual-band antenna according to the present invention.
Figure 4B:
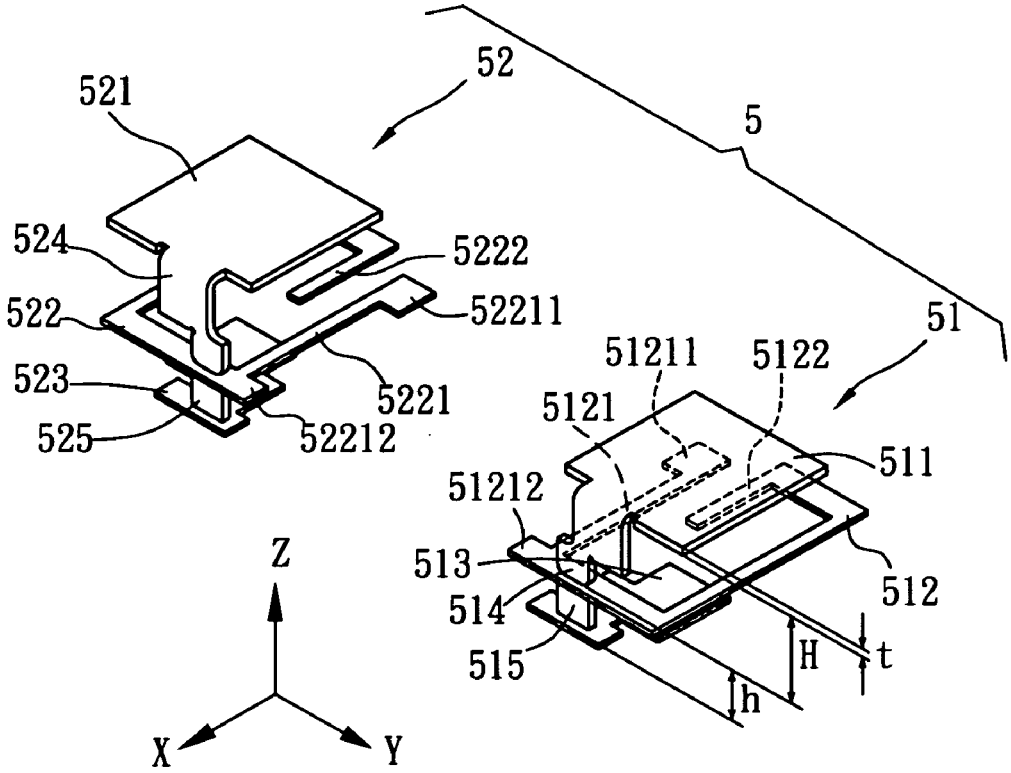
FIG. 4B is an assembled perspective view of the dual-band antenna according to the present invention.

Please refer to FIGS. 4A and 4B for an exploded perspective view and an assembled perspective view, respectively, of a preferred embodiment of the dual-band antenna 5 of the present invention. As shown in the drawings, the dual-band antenna 5 includes two corresponding antenna portions, namely a left antenna portion 51 and a right antenna portion 52, wherein each antenna portion 51, 52 includes a first radiator 511, 521; a second radiator 512, 522; a third radiator 513, 523; a stand portion 514, 524; and a conductive post 515, 525.

In the left and right antenna portions 51, 52, the first radiators 511, 521 are connected to the second radiators 512, 522 via the metallic plate-shaped stand portions 514, 524, respectively, such that the first radiators 511, 521 are generally parallel to the second radiators 512, 522. In this embodiment, each stand portion 514, 524 is formed by a stamping process and, more specifically, by bending a metal plate extending from one end of the corresponding first radiator 511, 521. Thus, each stand portion 514, 524 and the corresponding first radiator 511, 521 form a single-piece element having a 90-degree angle. Besides, each stand portion 514, 524 has a lower end extended with an engaging structure whereby the corresponding first radiator 511, 521 is engaged with and thereby secured in position to the substrate 71; and in consequence, the two first radiators 511, 521 are supported away from the top surface of the substrate 71 by the two stand portions 514, 524, respectively. In this embodiment, the second radiators 512, 522 are formed on the top surface or an inner layer of the substrate 71. Therefore, due to the height of the stand portions 514, 524, the first radiators 511, 521 are spaced apart from the second radiators 512, 522 by a predetermined distance H. Furthermore, in the left and right antenna portions 51, 52, the two third radiators 513, 523 are formed on the bottom surface or an inner layer of the substrate 71; are respectively and electrically connected to the two second radiators 512, 522 by the two conductive posts 515, 525; and are parallel to the second radiators 512, 522. In the present invention, the first radiators 511, 521 are configured for signal oscillation and thereby producing a second frequency ranging generally from 4.9 GHz to 5.85 GHz, which is a high-frequency band commonly used for wireless network communication. On the other hand, the second radiators 512, 522 are configured for signal oscillation and thereby producing a first frequency ranging generally from 2.4 GHz to 2.5 GHz, which is another band commonly used for wireless network communication.

In other words, in the preferred embodiment of the dual-band antenna of the present invention, the second radiators 512, 522 and the third radiators 513, 523 are directly provided on different circuit layers of a multilayer circuit board by a printed circuit technique. The third radiators 513, 523 are respectively and electrically connected to the second radiators 512, 522 by the conductive posts 515, 525 (i.e., vias typically used for electrical connection between different circuit layers in a multilayer printed circuit board). Moreover, the third radiators 513, 523 are parallel to the second radiators 512, 522 and spaced apart therefrom by the height h of the conductive posts 515, 525. Hence, the third radiators 513, 523 are also parallel to the first radiators 511, 521.

Referring to FIG. 5 in conjunction with FIGS. 4A and 4B, the left and right antenna portions 51, 52 of the dual-band antenna 5 are substantially symmetrically provided on two lateral sides of a circuit layer 713 in the substrate 71, and the left and right antenna portions 51, 52 substantially correspond in shape to each other. Each first radiator 511, 521 is integrally formed by stamping, or more specifically by bending, a thin conductive metal plate (e.g., of copper, iron, aluminum, etc.) such that each first radiator 511, 521 has a substantially uniform thickness t except at the bent portion. In addition, the first radiators 511, 521 are independently provided outside the substrate 71. The engaging structure extending from the lower end of each stand portion 514, 524 is configured for engaging with an engaging hole of the substrate 71 and thereby fixing each first radiator 511, 521 in position to the substrate 71, such that the two first radiators 511, 521 are supported away from the top surface of the substrate 71 by the two stand portions 514, 524, respectively.

Each second radiator 512, 522 is generally C-shaped and has a connecting section 5121, 5221 and a free-end portion 5122, 5222. A ground end 51211, 52211 and an input end 51212, 52212 are respectively provided at predetermined positions on the two ends of each connecting section 5121, 5221 and are respectively and electrically connected to the circuit layer 713 in the substrate 71 that is provided with the grounding portion 711 and the control circuit 712. Starting from the input end 51212, 52212 of the connecting section 5121, 5221, each second radiator 512, 522 is extended in such as way as to form a slender C-shaped structure, wherein the free-end portion 5122, 5222 at one end of the C-shaped structure overlaps with the orthogonal projection of the corresponding first radiator 511, 521 and is parallel to the corresponding first radiator 511, 521. At each input end 51212, 52212, an input line 714 is electrically connected to the control circuit 712 in the circuit layer 713 by soldering or by other metal wire connecting techniques, so as to provide signal transmission. In this embodiment, the second radiators 512, 522 are formed on the top surface or an inner layer of the substrate 71.

The third radiators 513, 523 are thin conductive metal plates provided on a certain layer of the substrate 71 or are formed on a certain layer of the substrate 71 by a printed circuit technique. Furthermore, the third radiators 513, 523 are respectively and electrically connected to the second radiators 512, 522 via the conductive posts 515, 525. Thus, the first radiators 511, 521; the second radiators 512, 522; and the third radiators 513, 523 are parallel to and spaced apart from one another by a predetermined distance to form three spaced layers of radiators.

As shown in FIGS. 6A and 6B, which are two perspective views of a preferred embodiment of a wireless network device having the dual-band antenna of the present invention, the left and right antenna portions 51, 52 of the dual-band antenna 5 are independently and symmetrically provided on the same end surface of the substrate 71 of the wireless network device 7.

The control circuit 712 is provided on one of the circuit layers 713 in the substrate 71 and includes a circuit layout, several IC elements, and several electronic elements so as to carry out wireless network transmission in accordance with the 802.11a, 802.11b, 802.11g, 802.11n, or ultra-wideband (UWB) communication protocol. As the control circuit 712 is well known in the art and not a major technical feature of the present invention, a detailed description of the control circuit 712 is omitted herein.

The dual-band antenna 5 is installed on the substrate 71 of the wireless network device 7 in such a way that the first radiators 511, 521 of the left and right antenna portions 51, 52 are secured on two lateral sides of one end of the substrate 71 via the stand portions 514, 524, respectively, and are respectively and electrically connected to the second radiators 512, 522 in the substrate 71. Furthermore, the stand portions 514, 524 have surfaces generally perpendicular to a surface of the substrate 71 such that the first radiators 511, 521 are generally parallel to the substrate 71.

The USB connector end 72 of the wireless network device 7 is electrically connected to the control circuit 712 of the substrate 71, wherein USB refers to a bus conforming to the USB2.0, USB3.0 or other transmission specifications. It is understood that the wireless network device 7 may further include a Bluetooth device (not shown) electrically connected to the control circuit 712 so as to enable Bluetooth transmission. Since Bluetooth technology is a well-known and widely used wireless communication technique, a detailed description thereof is omitted herein.

Figure 7A:
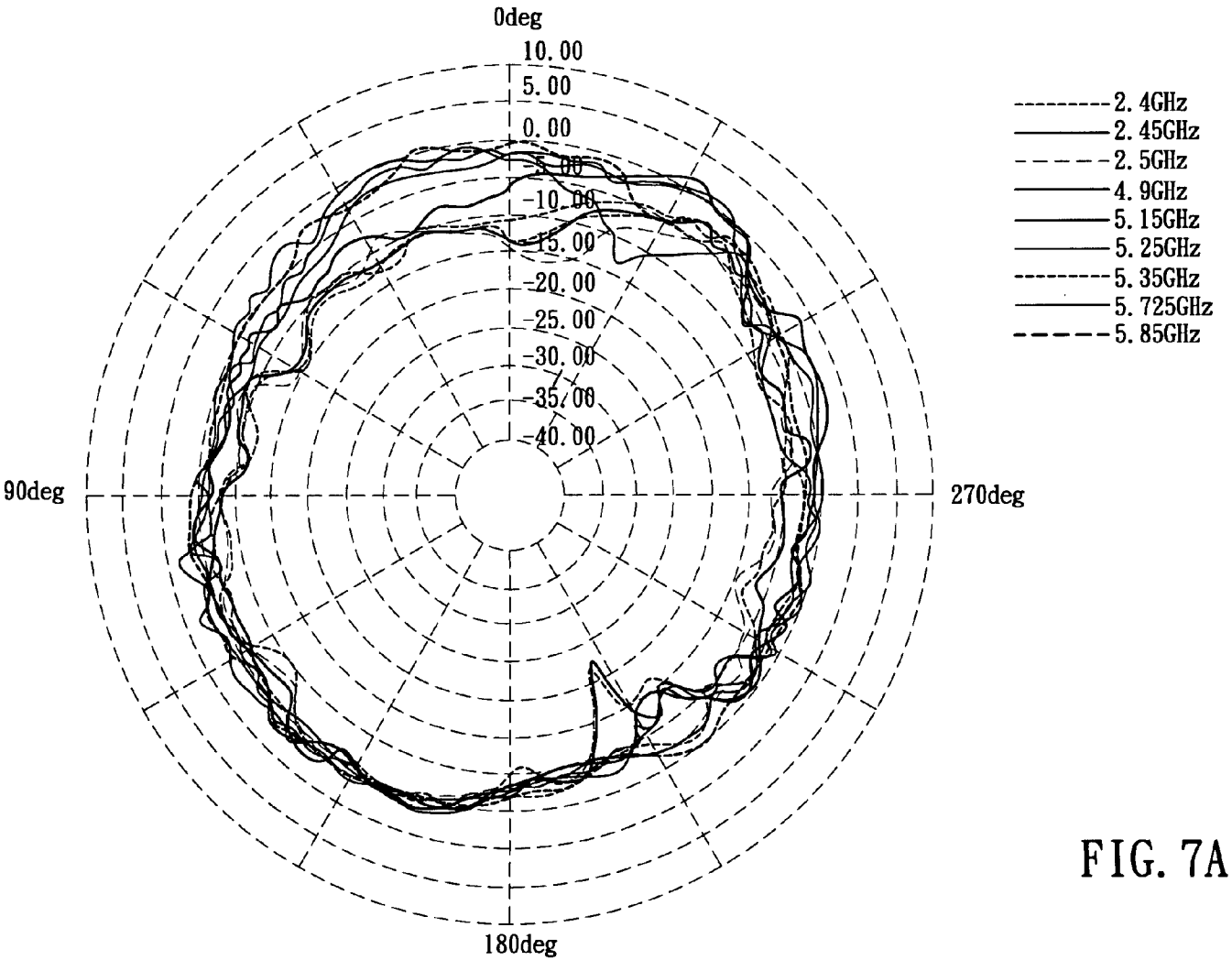
FIG. 7A shows X-Y plane radiation patterns plotted from the test results of a left antenna portion of the dual-band antenna of the present invention in the application band (2.4 GHz~5.85 GHz)

FIG. 7A shows X-Y plane radiation patterns plotted from test results of the left antenna portion of the dual-band antenna of the present invention, including radiation patterns corresponding to the first frequency (which ranges from 2.4 GHz to 2.5 GHz) and radiation patterns corresponding to the second frequency (which ranges from 4.9 GHz to 5.85 GHz).

Figure 7B:
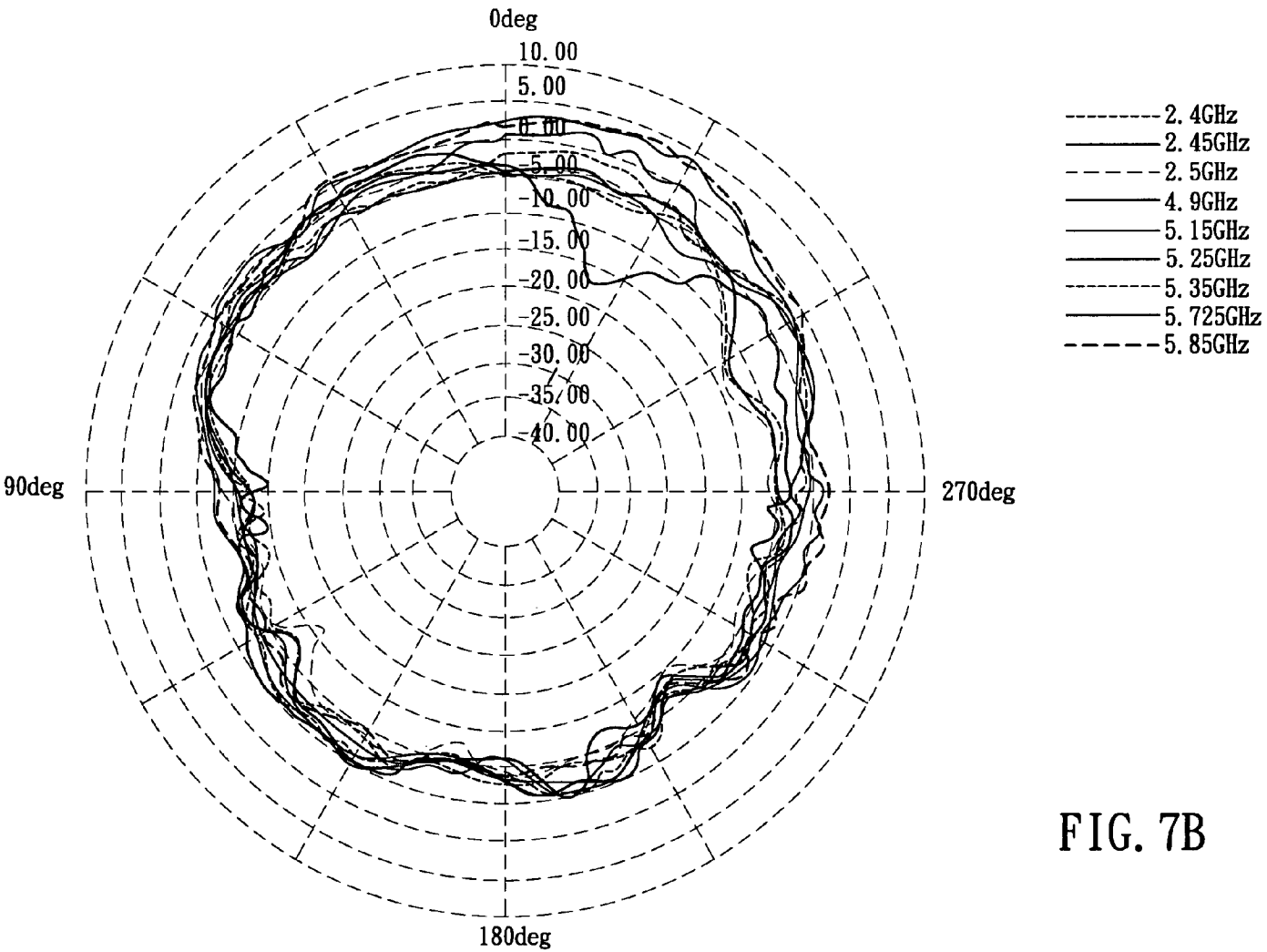
FIG. 7B shows X-Y plane radiation patterns plotted from the test results of a right antenna portion of the dual-band antenna of the present invention in the application band (2.4 GHz~5.85 GHz)

FIG. 7B shows X-Y plane radiation patterns plotted from test results of the right antenna portion of the dual-band antenna of the present invention, including radiation patterns corresponding to the first frequency (which ranges from 2.4 GHz to 2.5 GHz) and radiation patterns corresponding to the second frequency (which ranges from 4.9 GHz to 5.85 GHz).

Table 1 shows the test results of gain (dBi) and efficiency (%) of the left and right antenna portions of the dual-band antenna of the present invention at the first frequency (low frequency) and the second frequency (high frequency), respectively.

TABLE 1

| | | Duel-band Antenna | | | |
|---|---|---|---|---|---|
| | | Left Antenna Portion | | Right Antena Portion | |
| | Frequency | Gain (dBi) | Efficiency (%) | Gain (dBi) | Efficiency (%) |
| First Frequency | 2.40 GHz | 0.42 | 30.55 | 0.36 | 37.00 |
| | 2.45 GHz | 0.77 | 32.40 | 0.19 | 36.83 |
| | 2.50 GHz | 0.34 | 26.98 | −0.45 | 30.45 |
| Second Frequency | 4.90 GHz | 2.08 | 47.52 | 1.77 | 41.18 |
| | 5.15 GHz | 2.46 | 49.87 | 2.31 | 45.63 |
| | 5.25 GHz | 2.96 | 50.21 | 2.30 | 45.42 |
| | 5.35 GHz | 3.12 | 54.04 | 2.49 | 48.38 |
| | 5.725 GHz | 4.18 | 52.71 | 3.42 | 52.35 |
| | 5.850 GHz | 4.14 | 53.32 | 3.21 | 53.63 |

Referring to the radiation patterns shown in FIG. 7A of the left antenna portion in conjunction with Table 1, the maximum vertical gain and the highest efficiency of the left antenna portion 51 at the first (low) frequency (which ranges from 2.4 GHz to 2.5 GHz) are 0.77 dBi and 32.4%, respectively, and the maximum vertical gain and the highest efficiency of the left antenna portion 51 at the second (high) frequency (which ranges from 4.9 GHz to 5.85 GHz) are 4.18 dBi and 54.04%, respectively.

On the other hand, referring to the radiation patterns shown in FIG. 7B of the right antenna portion in conjunction with Table 1, the maximum vertical gain and the highest efficiency of the right antenna portion 52 at the first (low) frequency (which ranges from 2.4 GHz to 2.5 GHz) are 0.36 dBi and 37%, respectively, and the maximum vertical gain and the highest efficiency of the right antenna portion 52 at the second (high) frequency (which ranges from 4.9 GHz to 5.85 GHz) are 3.42 dBi and 53.63%, respectively.

Figure 1:
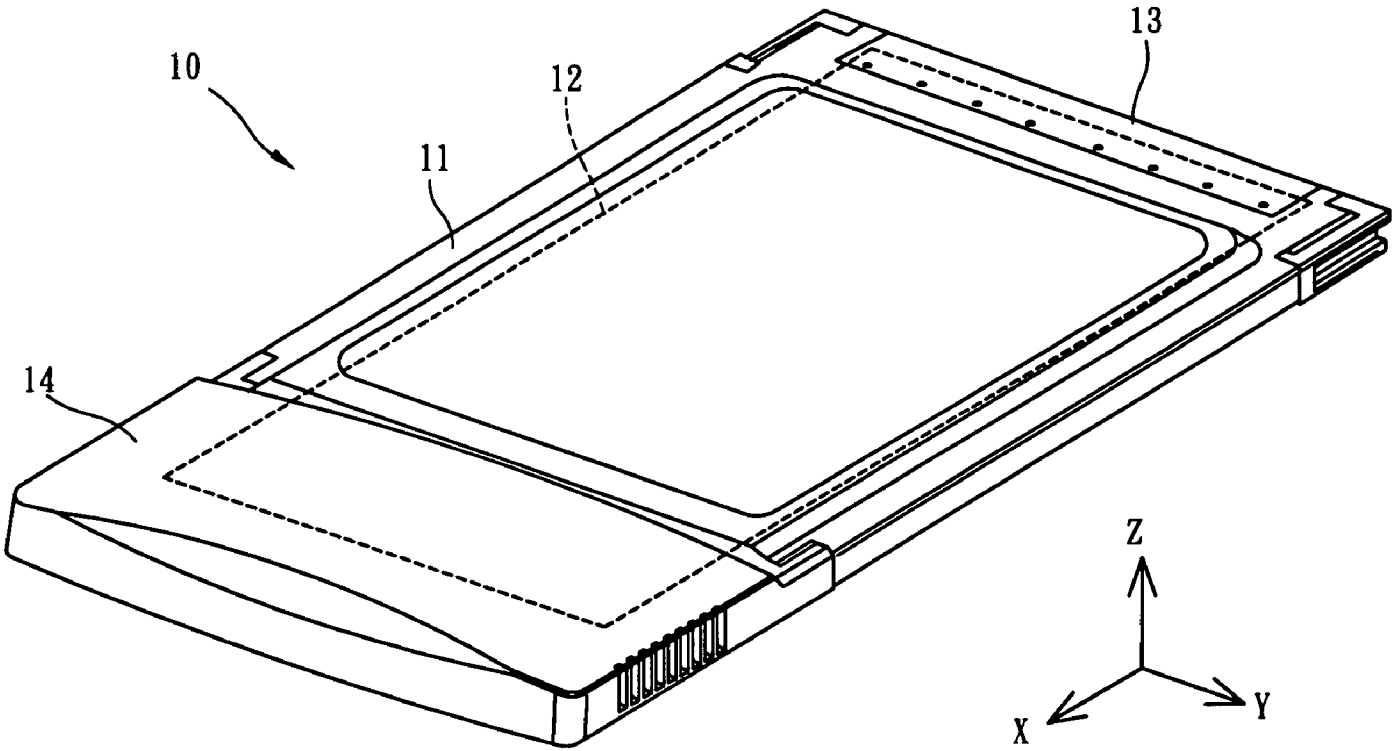
FIG. 1 (PRIOR ART)
FIG. 1 is a perspective view of a typical wireless network device.
Figure 2:
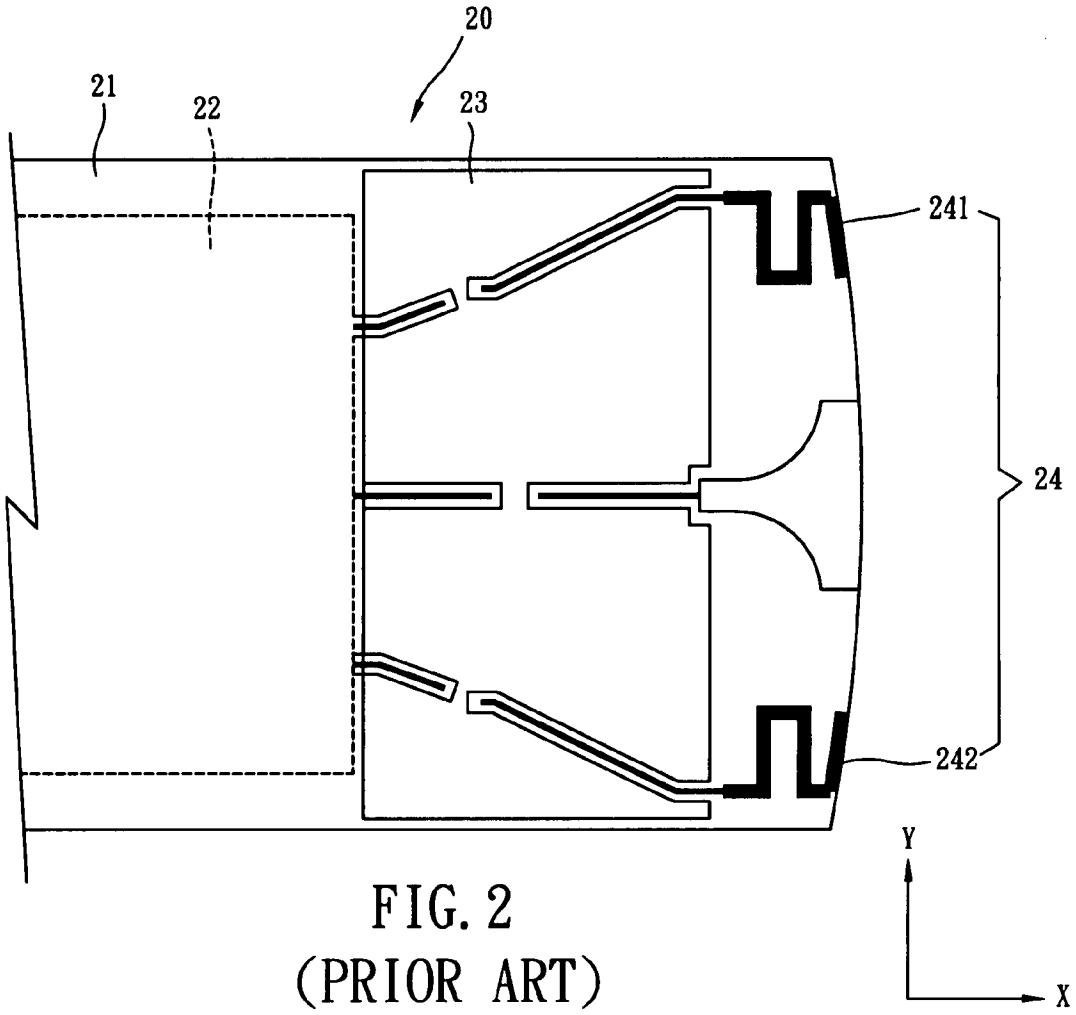
FIG. 2 (PRIOR ART)
FIG. 2 schematically shows a conventional internal circuit device for use in a wireless network device.
Figure 3:
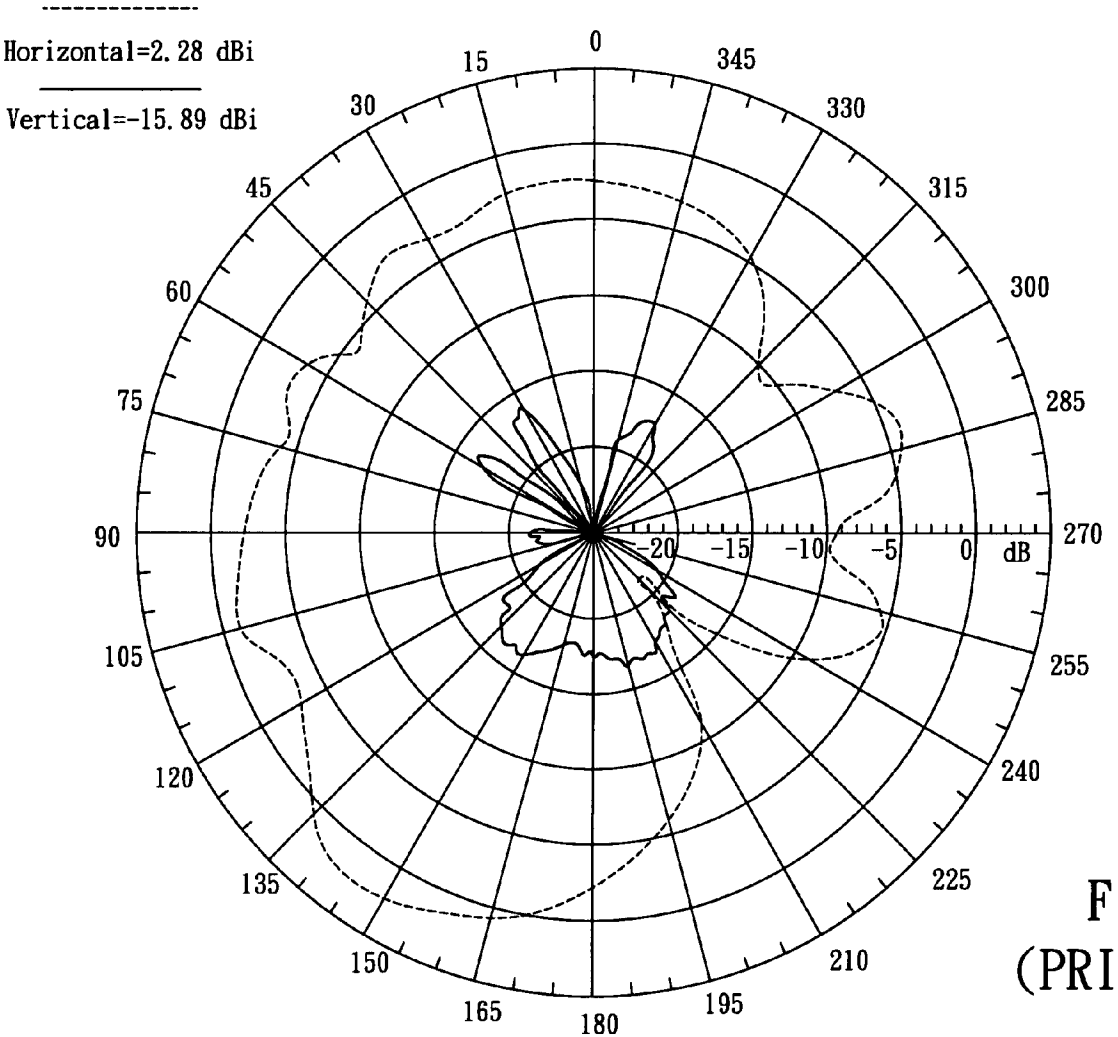
FIG. 3 (PRIOR ART)
FIG. 3 is an X-Y plane radiation pattern plotted from test results of a first antenna of the conventional antenna unit shown in FIG. 2.

It can be further known from FIGS. 7A and 7B and Table 1 that the left and right antenna portions 51, 52 of the dual-band antenna 5 have much higher gain values in the X-Y plane than the prior art shown in FIGS. 2 and 3 (whose maximum gain value is −15.89 dBi). Besides, the gain values of the left and right antenna portions 51, 52 of the dual-band antenna 5 at both the first and second frequencies form generally circular radiation patterns, meaning that the dual-band antenna 5 is capable of relatively uniform radiation at different angles and in different directions, has no dead zones, and therefore provides good communication quality.

In addition, the test results of return losses of the left and right antenna portions of the dual-band antenna of the present invention in the X-Y plane at the first and second frequencies are shown in Table 2.

TABLE 2

| | | X-Y Plane | |
|---|---|---|---|
| Duel-band Antenna | Frequency | Return Loss of Left Antenna Portion (dB) | Return Loss of Right Antenna Portion (dB) |
| First Frequency | 2.40 GHz | −13.462 | −13.787 |
| | 2.45 GHz | −16.587 | −26.313 |
| | 2.50 GHz | −22.146 | −17.264 |
| Second Frequency | 4.90 GHz | −12.899 | −16.679 |
| | 5.15 GHz | −16.321 | −23.252 |
| | 5.25 GHz | −15.070 | −16.464 |

TABLE 2-continued

| Duel-band Antenna | Frequency | X-Y Plane Return Loss of Left Antenna Portion (dB) | X-Y Plane Return Loss of Right Antenna Portion (dB) |
|---|---|---|---|
| | 5.35 GHz | −12.802 | −14.346 |
| | 5.725 GHz | −18.730 | −20.713 |
| | 5.850 GHz | −20.449 | −19.642 |

Figure 8A:
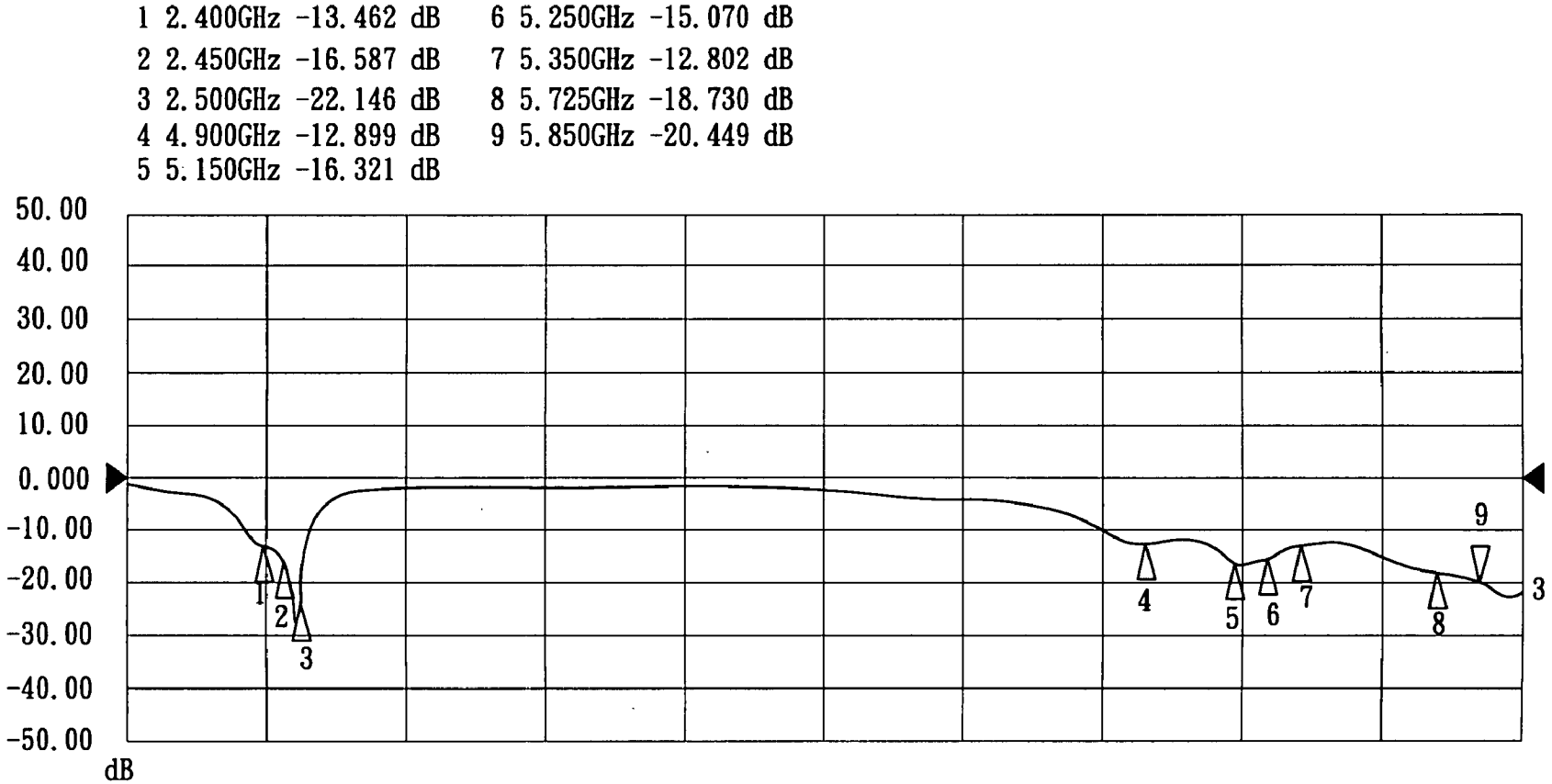
FIG. 8A is a return loss plot based on the test results of the left antenna portion of the dual-band antenna of the present invention in the application band (2.4 GHz~5.85 GHz)

Referring to FIG. 8A, which is a return loss plot based on the test results of the left antenna portion of the dual-band antenna of the present invention, in conjunction with Table 2, the return loss of the left antenna portion 51 of the dual-band antenna 5 at the first (low) frequency (which ranges from 2.4 GHz to 2.5 GHz) is generally between −13.462 dB and −22.146 dB, and the return loss of the left antenna portion 51 of the dual-band antenna 5 at the second (high) frequency (which ranges from 4.90 GHz to 5.850 GHz) is generally between −12.802 dB and −20.449 dB.

Figure 8B:
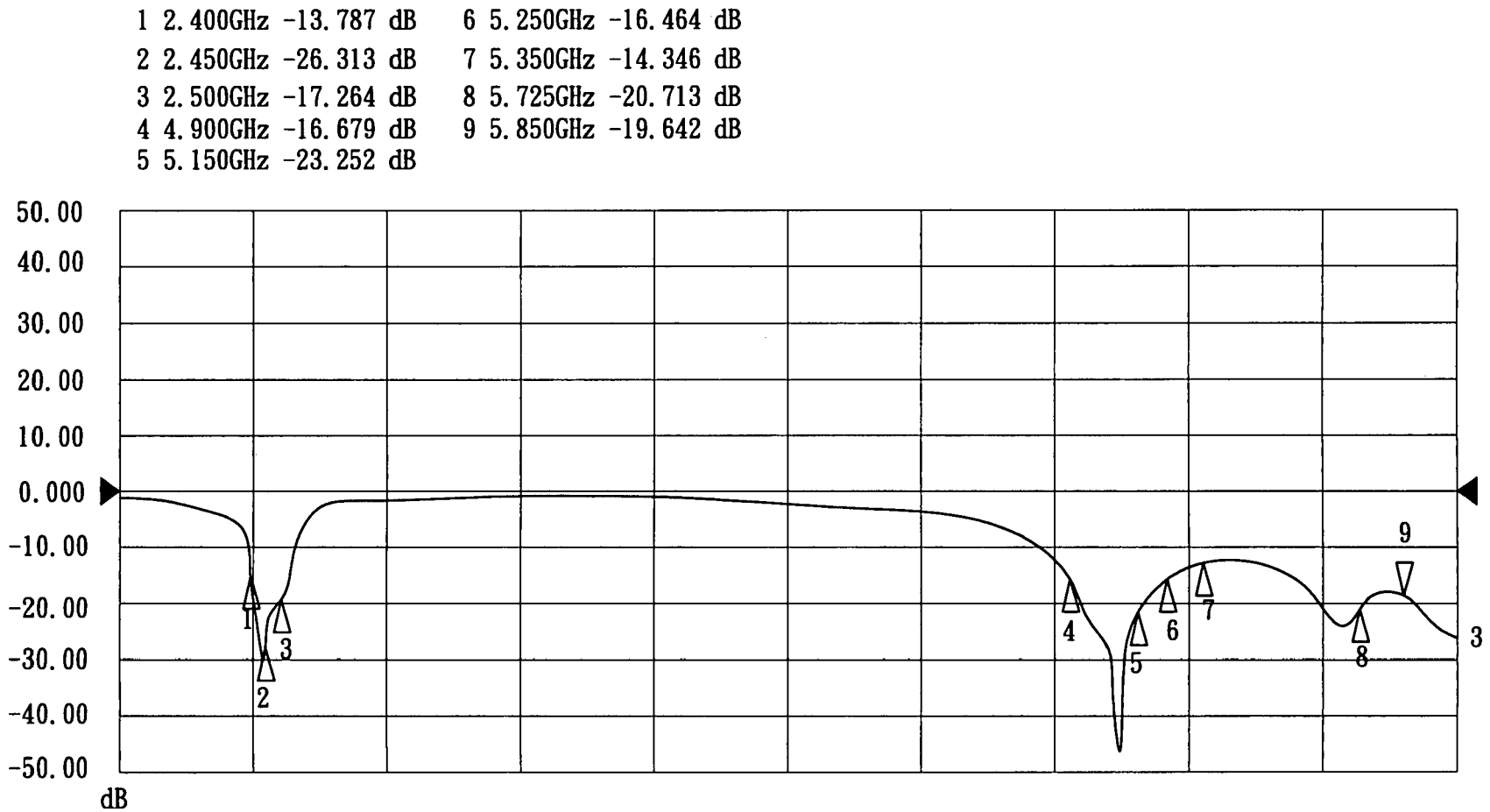
FIG. 8B is a return loss plot based on the test results of the right antenna portion of the dual-band antenna of the present invention in the application band (2.4 GHz~5.85 GHz).

Referring to FIG. 8B, which is a return loss plot based on the test results of the right antenna portion of the dual-band antenna of the present invention, in conjunction with Table 2, the return loss of the right antenna portion 52 of the dual-band antenna 5 at the first (low) frequency (which ranges from 2.4 GHz to 2.5 GHz) is generally between −13.787 dB and −26.313 dB, and the return loss of the right antenna portion 52 of the dual-band antenna 5 at the second (high) frequency (which ranges from 4.90 GHz to 5.850 GHz) is generally between −14.346 dB and −23.252 dB.

With return losses lower than −10 dB at the first (low) frequency (2.4 GHz, 2.45 GHz, and 2.5 GHz) as well as the second (high) frequency (4.9 GHz, 5.15 GHz, 5.25 GHz, 5.35 GHz, 5.725 GHz, and 5.85 GHz), the left and right antenna portions 51, 52 of the dual-band antenna of the present invention meet the design requirements of high-performance antennas on the market. It follows that the left and right antenna portions 51, 52 of the antenna 5 of the present invention provide efficient signal transmission, enable high-quality and stable dual-band wireless communication, allow fast manufacture and easy assembly to the substrate 71 of the wireless network device 7, and help reduce the costs and overall volume of the wireless network device 7 having the antenna 5.

The present invention has been described with preferred embodiments thereof, and it is understood that many changes and modifications to the described embodiment can be carried out without departing from the scope and the spirit of the invention that is intended to be limited only by the appended claims.

What is claimed is:

1. A dual-band antenna, provided on a substrate and comprising:

a first radiator;

a second radiator which is generally C-shaped and has a connecting section and a free-end portion, wherein a ground end and an input end are provided at predetermined positions of the connecting section and are respectively and electrically connected to a grounding portion and a control circuit of the substrate, and wherein the free-end portion overlaps with an orthogonal projection of the first radiator and is parallel to the first radiator;

a third radiator electrically connected to the second radiator via a conductive post and being parallel to the second radiator; and a stand portion connected to the first radiator and the second radiator;

wherein the substrate is a multilayer printed circuit board, the second and third radiators being provided on different layers of the substrate, the first radiator being independently provided outside the substrate, and the first, second, and third radiators being parallel to and spaced apart from one another by a predetermined distance.

2. The dual-band antenna of claim 1, wherein the second radiator is configured for signal oscillation and thereby producing a first frequency, and the first radiator is configured for signal oscillation and thereby producing a second frequency, the dual-band antenna thus having a dual-band function.

3. The dual-band antenna of claim 2, wherein the first frequency ranges from 2.4 GHz to 2.5 GHz, and the second frequency ranges from 4.9 GHz to 5.85 GHz.

4. The dual-band antenna of claim 1, wherein the first radiator and the stand portion are integrally formed as a single piece by stamping a thin conductive metal plate and are perpendicular to each other.

5. The dual-band antenna of claim 1, wherein said dual-band antenna comprises two corresponding antennas respectively and symmetrically provided on two lateral sides of the substrate, wherein the two antennas substantially correspond in shape to each other.

6. A wireless network device having a dual-band antenna, the wireless network device comprising:

a substrate formed as a multilayer printed circuit board, wherein the substrate is provided with a grounding portion configured for electrical grounding and a control circuit configured for providing wireless network communication;

a bus connector end electrically connected to the control circuit of the substrate; and at least a said dual-band antenna comprising:

a first radiator;

a second radiator which is generally C-shaped and has a connecting section and a free-end portion, wherein a ground end and an input end are provided at predetermined positions of the connecting section and are respectively and electrically connected to the grounding portion and the control circuit of the substrate, and wherein the free-end portion overlaps with an orthogonal projection of the first radiator and is parallel to the first radiator;

a third radiator electrically connected to the second radiator via a conductive post and being parallel to the second radiator; and a stand portion connected to the first radiator and the second radiator;

wherein the second and third radiators are provided on different layers of the substrate, the first radiator is provided outside the substrate, and the first, second, and third radiators are parallel to and spaced apart from one another by a predetermined distance.

7. The wireless network device of claim 6, wherein the second radiator is configured for signal oscillation and thereby producing a first frequency, and the first radiator is configured for signal oscillation and thereby producing a second frequency, the dual-band antenna thus having a dual-band function.

8. The wireless network device of claim 7, wherein the first frequency ranges from 2.4 GHz to 2.5 GHz, and the second frequency ranges from 4.9 GHz to 5.85 GHz.

9. The wireless network device of claim 6, wherein the first radiator and the stand portion are integrally formed as a single piece by stamping a thin conductive metal plate and are perpendicular to each other.

10. The wireless network device of claim 6, wherein said at least a dual-band antenna comprises two corresponding antennas respectively and symmetrically provided on two lateral sides of the substrate, wherein the two antennas substantially correspond in shape to each other.

* * * * *